US005511876A

United States Patent [19]

Plessers et al.

[11] Patent Number: 5,511,876

[45] Date of Patent: Apr. 30, 1996

[54] DEVICE FOR MIXING SOLID PHOTOGRAPHIC CHEMICALS WITH WATER

[75] Inventors: Hendrik Plessers, Wijchmaal, Belgium; Dieter Dahlmann, Wuppertal, Germany

[73] Assignee: Agfa-Gevaert, N.V., Mortsel, Belgium

[21] Appl. No.: 387,489

[22] Filed: Feb. 13, 1995

[30] Foreign Application Priority Data

Mar. 8, 1994 [EP] European Pat. Off. ..... 94200583

[51] Int. Cl.[6] ..... B01F 15/02

[52] U.S. Cl. ..... 366/153.1; 366/171.1; 366/183.1

[58] Field of Search ..... 366/153.1, 160.1, 366/160.2, 162.1, 167.1, 168.1, 177.1, 181.1, 183.1, 262, 263, 265, 270, 171.1; 137/392

[56] References Cited

U.S. PATENT DOCUMENTS

| | | | |
|---|---|---|---|
| 1,374,747 | 11/1921 | Seeley | 366/168.1 |
| 1,560,826 | 11/1925 | Kirschbraun | 366/168.1 X |
| 1,911,644 | 5/1933 | Overbury | 366/262 X |
| 2,171,312 | 8/1939 | Meyers | 366/168.1 X |
| 3,421,538 | 1/1969 | Hembree | 137/392 X |
| 3,738,534 | 6/1973 | Abbott | 366/262 X |
| 4,099,267 | 7/1978 | King | 366/181.1 X |
| 4,660,990 | 4/1987 | Svensson | 366/263 X |

*Primary Examiner*—Charles E. Cooley
*Attorney, Agent, or Firm*—Breiner & Breiner

[57] ABSTRACT

Preparation device for mixing solid chemical components with water to obtain a solution for the liquid processing of a photographic material, which comprises a tank (12), an open-topped sub-tank (12) mounted in the tank at a level below the maximum level of liquid therein, a chute (16) for passing powder discharged on top of the device into the sub-tank, a mixer in the sub-tank for mixing powder with liquid contained in the sub-tank, and controls for controlling the operation of water supply (26), circulation (21) and mixing.

8 Claims, 2 Drawing Sheets

DEVICE FOR MIXING SOLID PHOTOGRAPHIC CHEMICALS WITH WATER

BACKGROUND OF THE INVENTION

1. Field of the Invention

The present invention relates to a preparation device for mixing one or more solid chemical components with water to obtain a solution for the liquid processing of photographic material.

2. Description of the Art

Mixers of powdery chemicals are known for use in the preparation of photographic processing solutions, such as developer and fixing baths. Advantages of powdery over liquid chemicals are a considerable reduction of packaging material a reduction of transport costs because of reduced weight, and smaller storage area.

However, the operation required for mixing powder with water to obtain a ready photographic solution is a disadvantage. Mixing relatively small volumes of liquid, of the order of magnitude of 20 l or less does not raise problems in practice, but mixing larger volumes can cause the powder congealing and sinking to the bottom unless expensive mixing devices are used.

SUMMARY OF THE INVENTION

OBJECT OF THE INVENTION

It is an object of the present invention to provide an improved preparation device for mixing chemical components with water to obtain a solution for liquid processing photographic material, which allows also larger volumes, as defined hereinbefore, of processing solution to be prepared without complicated mixing provisions.

It is a secondary object of the invention to provide an arrangement which can be easily incorporated in existing preparation devices devised for liquid chemicals to make them suited for powdery chemicals.

STATEMENT OF THE INVENTION

In accordance with the present invention, a preparation device for mixing one or a plurality of solid chemical components with water to obtain a solution for the liquid processing of a photographic material, which comprises a tank, means for filling said tank with water up to a predetermined level, powder supply means for feeding one or more chemical components in powder form into the tank, and circulation means for blending the mixture in said tank, is characterized in that it further comprises an open-topped sub-tank mounted in said tank at a level below the maximum level of liquid therein, a chute for passing powder discharged on top of the device into said sub-tank, mixing means in said sub-tank for mixing powder with liquid contained in said sub-tank, and control means for controlling the operation of said water supply, circulation and mixing means, so that the mixing of powder with liquid in said sub-tank is started while the level of liquid in the tank is below the top of the sub-tank, said water supply means is started to fill the tank such that the liquid in the tank overflows the sub-tank after mixing therein has been completed, and the operation for the circulation means is continued at least until the solution of the sub-tank has become mixed with the liquid in the tank.

The term "powder" as used in the present specification includes also chemical compounds in granulate form.

The device according to the invention does not comprise conduits and/or electromagnetic valves interconnecting the sub-tank with the main tank, so that the sub-tank operates as an independent element in the main tank requiring no maintenance or specific control whatsoever.

The control means mentioned in the statement are the usual means that are present in devices of the described kind, viz. an electromagnetic valve in the water supply, a minimum- and a maximum-liquid level sensor, and a processor for processing the signals from both sensors.

Suitable embodiments of a preparation device according to the invention are as follows.

The sub-tank is mounted on the bottom of the main tank and has generally the shape of an inverted truncated cone.

The control means controls the operation of the mixing means so that mixing in the sub-tank continues as long as blending in the tank proceeds.

The sub-tank has on its top liquid-flow-restraining means with a central opening. The liquid-flow-restraining means suitably has an annular shape, and suitably said flow-restraining means is formed by a sieve.

The mixing means in the sub-tank is an axial-flow impeller, and the chute ends near the shaft of said impeller.

BRIEF DESCRIPTION OF THE DRAWINGS

The invention will be described hereinafter by way of example with reference to the accompanying drawings, wherein.

DETAILED DESCRIPTION OF THE INVENTION

Figure 1:
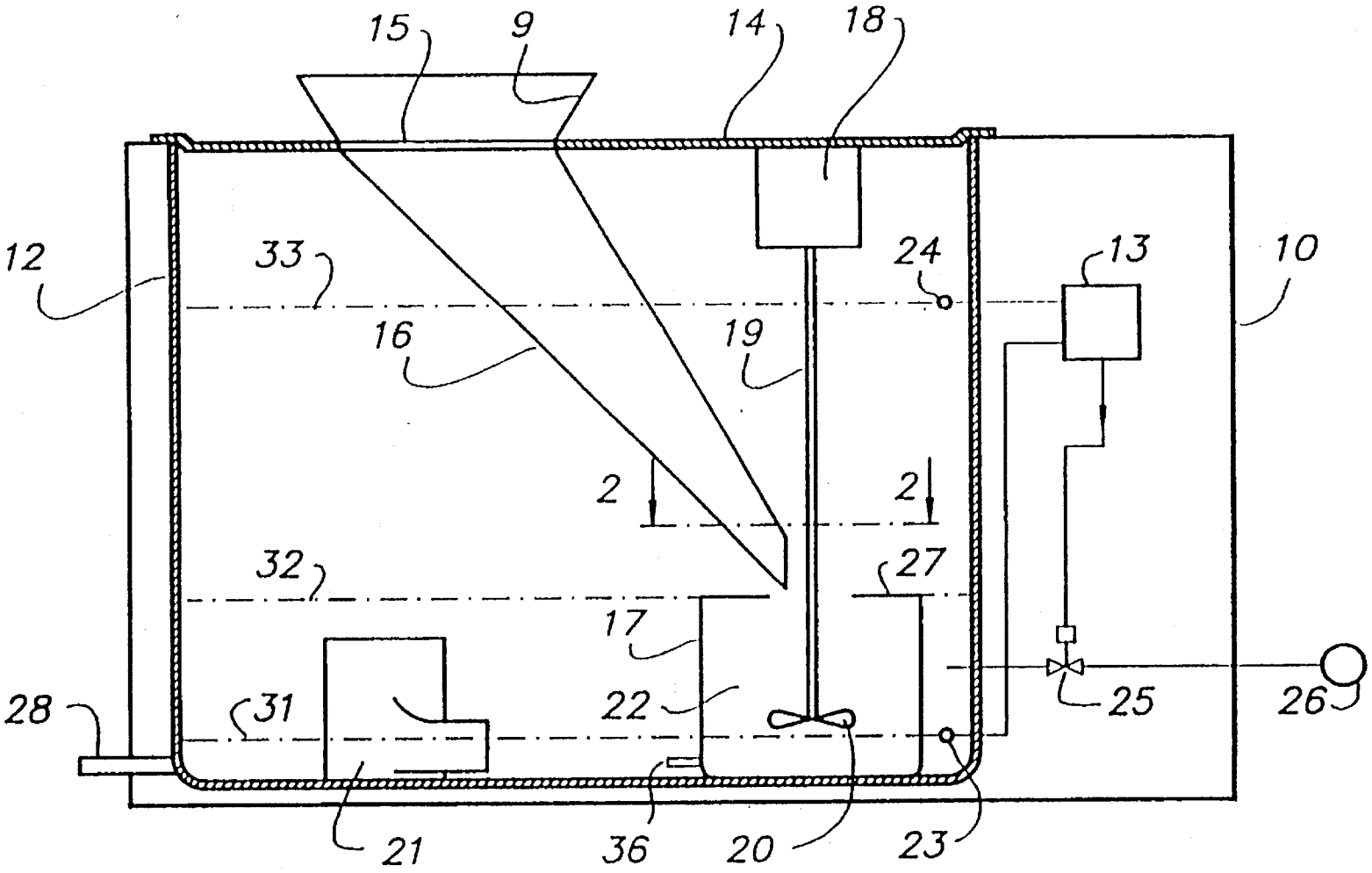
FIG. 1 is a diagrammatic vertical section through one embodiment of a preparation device according to the invention, FIG. 2 a top view of the sub-tank according to line 2—2 of FIG. 1.

FIG. 1 shows diagrammatically one embodiment of a photographic preparation device according to the invention. The device generally consists of a rectangular housing 10 with a tank 12 and control means 13. The tank is closed by a cover 14 having an opening 15 giving access to a chute 16 in the form of a sloping generally conical tube. A hopper 9 forms a widened inlet of the opening 15.

An open-top cylindrical sub-tank 17 is fitted on the bottom of tank 12. A mixer 18 is fitted to cover 14 and has a shaft 19 with an impeller 20 dipping in sub-tank 17.

An immersion pump 21 is placed on the bottom of tank 12. No hose is connected to the outlet of this pump since its only function is to blend the liquid mixture in the tank.

A minimum-level sensor 23 for level 31 and a maximum-level sensor 24 for level 33 are fitted in a sidewall of tank 12. Their output signals are processed by controller 13 that controls valve 25 of a water supply circuit 26.

Figure 2:
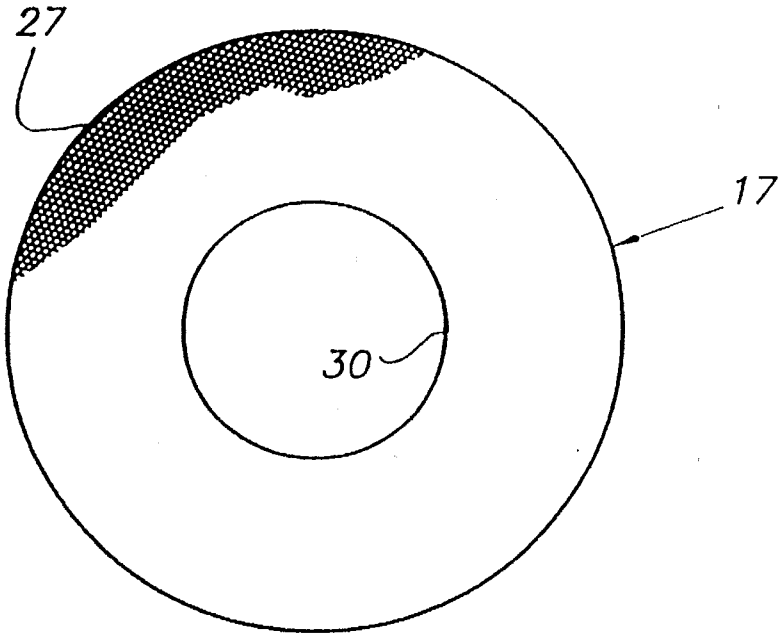

FIG. 2 is a top view of sub-tank 17 on line 2—2 of FIG. 1. The open-top side of the sub-tank is provided with an annular cover 27 fixedly connected therewith. The diameter of opening 30 of the cover equals approximately ⅓ of the outer diameter. The cover is made of a rigid sieve-like material.

The operation of the preparation device is as follows.

A previous mixture having been used by feeding via outlet 28 and suitable pump means to a photographic processor, sensor 23 having signalled the need for a next preparation operation, and sub-tank 17 remaining filled with ready-to-use processing liquid, the operator starts the operation of the device.

Controller 13 opens valve 25 whereby water is admitted to the device. The incoming water is blended by immersion pump 21 with the ready-to-use solution left on the bottom of tank 12.

Controller 13 has also started the operation of impeller 20. Rotating impeller 20 causes the liquid mass in sub-tank 17 to rotate about the axis of the impeller whereby liquid is forced outwardly by centrifugal forces causing a partial overflow of liquid over the rim of the sub-tank, while first passing through the sieve. A free liquid surface becomes established in the sub-tank as indicated approximately by broken line 29, see FIG. 3.

The operator then slowly discharges the solid chemical components through hopper 15 in chute 16, which conducts them through opening 30 of sieve 27 in the central portion of the rotating liquid mass. The solid components are instantly flung radially outward by the rotating liquid body 22 but are withheld from being thrown out of the tank by sieve 27. As the rotation of impeller 20 and the supply of chemicals continue, the solid components become gradually mixed with the liquid in the sub-tank. It has been shown that mixed powder passes through the pores of the sieve, whereas unmixed powder does not. In this way the unmixed powder remains within the sub-tank until mixed whereas mixed powder automatically provides space for fresh, unmixed powder.

As all the solid chemical components have been discharged in the sub-tank, the level of the liquid therein is still as indicated by broken line 29. The concentration of the mixture is high. Mixed liquid having been thrown out of the sub-tank flows in the liquid on the bottom of tank 12 and becomes mixed therewith.

Figure 3:
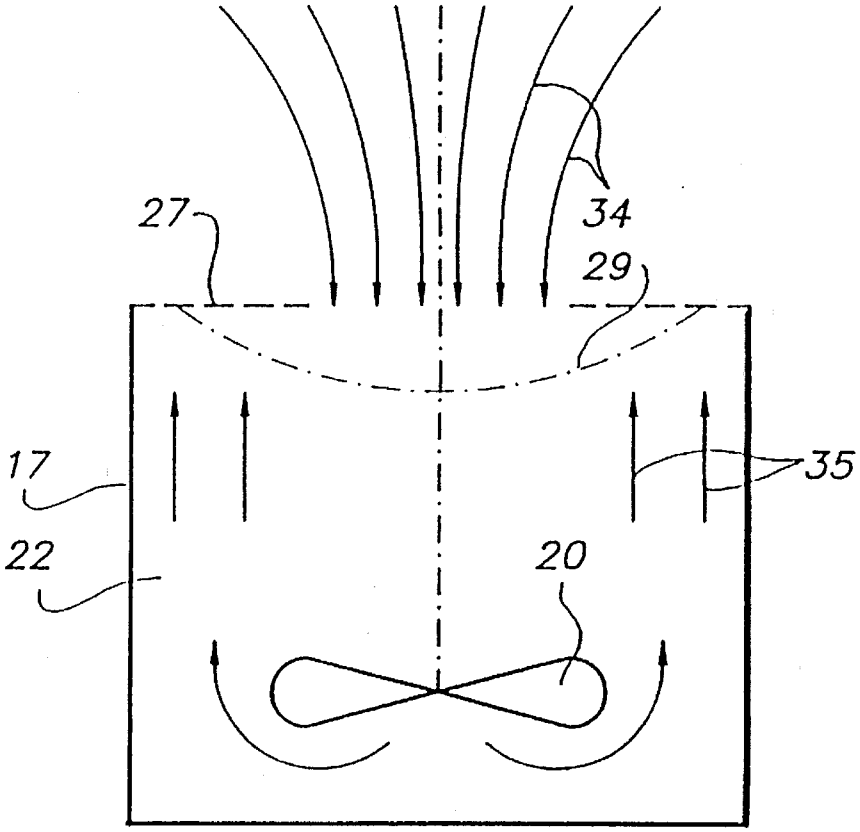
FIG. 3 is an enlarged sectional view of the sub-tank of FIG. 1.

As the liquid in tank 12 surpasses level 32, i.e. that determined by the rim of the sub-tank, it is drawn into sub-tank 17 as indicated by the arrows 34 in FIG. 3, by the suction produced by mixer 20, mixed with the contents therein and then forced outwardly through the sieve as indicated by arrows 35 under the pressure of further liquid being drawn into the sub-tank. The mentioned proces continues for a period ranging between some minutes and some tens of minutes so that by the combined actions of mixer 18 and immersion pump 21 the composition of the solution in tank 12 is uniform at any place. As the liquid in the tank has reached level 33, valve 25 is closed and at that moment the solution is ready for use and can be pumped away from tank 12 through outlet 28.

When the liquid level in tank 12 falls below level 32, sub-tank 17 remains completely filled with liquid since there is no outlet opening for said sub-tank. This is to be considered as an inventive feature of the present embodiment of the preparation device since it allows to start the next preparation without having first to fill said tank with liquid.

The following data illustrate the device described hereinbefore.

| | |
|---|---|
| Tank 12 | 50 L |
| Sub-tank 17 | 5 L |
| Immersion pump | 12 $L.min^{-1}$ |
| Sieve 29: outer diameter | 250 mm |
| inner diamter | 90 mm |
| Pore opening | 0.8 mm |
| Material: perforated polypropylene foil | |

In the example described hereinbefore, only one chemical component only was mixed with the liquid in the preparation device. It will be understood that photographic processing compositions comprising more than one active component, such as developing and bleach-fixing compositions, can be prepared as well in the device according to the invention. In such case, the bags with the different components are opened, and the contents thereof are poured in succession in chute 16, after each previous component has been mixed in sub-tank 17.

There are also known vacuum packages containing several photographic compositions in a well-determined order, or separated from each other by suitable barrier layers. In such case, the one package is opened and the contents is gradually poured in the sub-tank for being mixed with water.

The invention is not limited to the embodiment of the preparation device described hereinbefore.

Sub-tank 17 can be provided with an outlet as illustrated diagramatically by 36 in FIG. 1, which can be either manually or automatically controllable, for emptying said tank at a desired moment, e.g. for cleaning or servicing purposes.

The sieve can be made from any material having a sufficient rigidity, and resistance to the used chemicals. Other suitable materials are cotton, PVC, stainless steel, etc.

The volume of the sub-tank stands in relation to that of the main tank and thus larger main tanks will require larger sub-tanks.

The central opening in the sieve is a function of the suction of the impeller 20 and in consequence the ratio on inner versus outer diameter of the sieve can take other values, than that of the described embodiment.

The preparation device need not necessarily be a new apparatus but can also be a modified prior art one, e.g. a mixing device for the preparation of photographic solutions on the base of liquid chemicals. Some prior art devices have a tank with a form-fitting cover with several hoppers having different shapes or sizes, to accomodate a particular bottle of chemicals.

Modification of such existing devices to operate with powder chemicals is easy, since the original cover need only be replaced by a modified one having a chute as tube 16. Further, sub-tank 17 and mixer 18 have to be provided.

We claim:

1. Preparation device for mixing one or a plurality of solid chemical components with water to obtain a solution for the liquid processing of a photographic material, which comprises a tank, water supply means for filling said tank with water up to a predetermined level, powder supply means for feeding said one or a plurality of solid chemical components in powder form into the tank, and circulation means for blending the mixture in said tank, characterized in that said device further comprises:

an open-topped sub-tank mounted in said tank and having a top which is at a level below said predetermined level in said tank, a chute for passing powder discharged from said powder supply means into said sub-tank, mixing means in said sub-tank for mixing said powder with liquid contained in said sub-tank, and control means for controlling the operation of said water supply, circulation and mixing means, so that the mixing of said powder with liquid in said sub-tank is started while the level of said liquid in said tank is below the top of the sub-tank, and said water supply means fills the tank such that the liquid in the tank overflows the sub-tank after mixing in said sub-tank has been completed, and the operation of the circulation means is continued at least until the liquid in the sub-tank has become mixed with the liquid in the tank.

2. Device according to claim 1, wherein said control means further controls the operation of said mixing means whereby mixing in said sub-tank continues as long as blending in said tank proceeds.

3. Device according to claim 2, wherein the top of said sub-tank has liquid-flow-restraining means with a central opening.

4. Device according to claim 3, wherein said liquid flow-restraining means has an annular shape.

5. Device according to claim 3, wherein said liquid-flow-restraining means is formed by a sieve.

6. Device according to claim 1, wherein said sub-tank has a circular cross-section.

7. Device according to claim 1, wherein the mixing means in said sub-tank is an axial-flow impeller, and said chute ends close to the rotational axis of said impeller.

8. Device according to claim 7, wherein said axial-flow impeller makes up a part of a mixer entering the top of said sub-tank.

* * * * *